US005378336A

United States Patent [19]

Bagnulo

[11] Patent Number: 5,378,336

[45] Date of Patent: Jan. 3, 1995

[54] INERT ANODE FOR DISSIPATION OF CONTINUOUS CURRENT

[75] Inventor: Luigi Bagnulo, Milan, Italy

[73] Assignee: Ecoline Anticorrosion S.R.L., Muggio, Italy

[21] Appl. No.: 904,438

[22] Filed: Jun. 25, 1992

[30] Foreign Application Priority Data

Jun. 25, 1991 [IT] Italy ..... MI 91A00173

[51] Int. Cl.[6] ..... C23F 13/00

[52] U.S. Cl. ..... 204/196; 204/147; 204/290 F

[58] Field of Search ..... 204/147, 148, 196, 197, 204/290 F

[56] References Cited

U.S. PATENT DOCUMENTS

| | | | |
|---|---|---|---|
| 2,491,225 | 12/1949 | Stearns | 204/147 |
| 3,038,849 | 6/1962 | Preiser | 204/196 |
| 3,133,872 | 5/1964 | Miller et al. | 204/196 |
| 3,202,596 | 8/1965 | Canevari | 204/197 |
| 3,260,661 | 7/1966 | Kemp et al. | 204/197 |
| 3,278,411 | 10/1966 | Williams | 204/290 F |
| 3,326,791 | 6/1967 | Heuze | 204/196 |
| 3,515,654 | 6/1970 | Bordalen et al. | 204/197 |
| 3,778,307 | 12/1973 | Beer | 204/290 F |
| 3,880,721 | 4/1975 | Littauer | 204/196 |
| 3,994,794 | 11/1976 | Bohne | 204/197 |
| 4,171,254 | 10/1979 | Koenecke | 204/197 |
| 4,267,029 | 5/1981 | Massarsky | 204/196 |

*Primary Examiner*—T. Tung
*Attorney, Agent, or Firm*—Michael J. Striker

[57] ABSTRACT

An indissoluble anode for dissipating current for electrochemical plants of underground or underwater structures, the anode comprises a core having a high resistance to radial crushing and bending,and a layer of titanium and applied over the core and has a free surface. A thin film of an indissoluble and current-dissipating metal is applied on the free surface of the titanium layer.

42 Claims, 1 Drawing Sheet

INERT ANODE FOR DISSIPATION OF CONTINUOUS CURRENT

BACKGROUND OF THE INVENTION

The present invention relates to inert anodes for dissipation of continuous current.

Metal structures, especially oil, gas and water pipelines as well as water and gas distribution networks buried or immersed in sea water or the like are subjected to spontaneous corrosion or corrosion caused by stray currents.

In order to prevent damage by these destructive phenomena, cathodic protection plants are provided. An indispensible component of these plants is a ground-bed formed by one or more anodes. The number of the anodes depends on their characteristics, the current to be dispersed and the expected working duration such a ground-bed has to have.

Initially the ground-beds were formed by using pieces of rail, pipes and other pieces of scrap iron as anodes. Because of high consumption rates (10 kg/A per annum), these types of anodes were subsequently substituted by graphite or silicon-iron anodes. These anodes usually have a cylindrical shape and low consumption rates (approximately 1 kg/A per annum).

These second types of anode are called "semi-inert" in virtue of their extensive life span. Recently, in addition to the above mentioned types other types of anodes have been introduced with an extremely extensive life span. They have therefore been termed "indissoluble" or "inert" anodes. These anodes are composed of titanium laminars or profiles coated over by a thin layer of indissoluble platinum produced by electrolytic means or by thermally produced oxides, especially of titanium iridium or ruthenium.

Even though, the latter types of anodes are widely used in industrial electrolytic plants, they did not find a practical application as part of the above-mentioned cathodic protection plants. Due to the low conductivity of the laying ground, the cathodic protection plant ground beds and therefore their anodes have to have an extensive dissipation surface, thus involving a considerable mass. Since titanium is a precious metal and therefore costly, the anodes of titanium (rods, tubes or profiles), are generally limited to a 2 centimeter diameter. In order to obtain a dissipating surface equal to that obtained when using a ground-bed of graphite or silicon-iron anodes of an approximately 8 centimeter diameter, titanium anodes of the same length and four times greater in number have to be used. This makes the cost of ground-beds of titanium anodes uneconomical. Since the required thickness of the titanium support useful for the application, efficiency and functioning of the dissipating layer needs only be of a few microns, it is self-evident that the use of titanium rods and tubes to serve as traditional anodes creates and unnecessary waste of valuable material.

SUMMARY OF THE INVENTION

Accordingly, it is an object of the present invention to provide a titanium anode which avoids the disadvantages of the prior art.

More particularly, it is an object of the present invention to provide a titanium anode which has extensive dissipating surface at low cost, coated with an inert layer.

In keeping with these objects and with others which will become apparent hereinafter, one feature of the present invention relates to an anode of the above mentioned type which has an element made of a rod, a tube or another geometrical shape and composed of an unbreakable, rigid, undeformable plastic material, and a first coating with a 100 micron average thickness copper lamina is applied on the above mentioned element. This lamina serves as an electro-conductor and has a width such that it is easy to apply either by spirally wrapping a tape or by enveloping a continuous foil around the element formed as a rod, a tube, or another profile, with possible overlaps between spirals or borders of about 5–10 millimeters. This lamina sticks to the underlying plastic surface and also in the regions of its overlap.

A second coating with a titanium lamina having a 100 micron average thickness is applied over the first lamina of copper with a width allowing spiral wrapping of a tape or enveloping of a continuous foil, and also has overlaps between spirals or borders of about 5–10 millimeter. The titanium lamina is covered by a thin indissoluble layer with a high adherence, hardness and resistance to bumps and scratching. It is provided for dissipation of current. The dissipating layer can be composed either of platinum or another noble metal electrically deposited on the titanium supporting laminar, or of thermally deposited titanium, iridium or ruthenium oxides. The titanium lamina adheres to the copper coating by means of an adhesive which is electroconductive due to dispersed metal granules within the adhesive matrix. It is resistant to the fluids into which the anodes are to be immersed.

An electrical feeder cable is connected either to one or both copper coated ends of the rod/tube/profile core of the anodes. Moreover, at each end of the anodes a waterproof sealing device or the like or a so-called "anode head" is provided and has a through hole for a feeder cable where needed. If the anode core is made as a steel rod/tube/profile the anode may not comprise the first copper conductive coating.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3, 4, 5, 6, 7, 8, 9, 10:
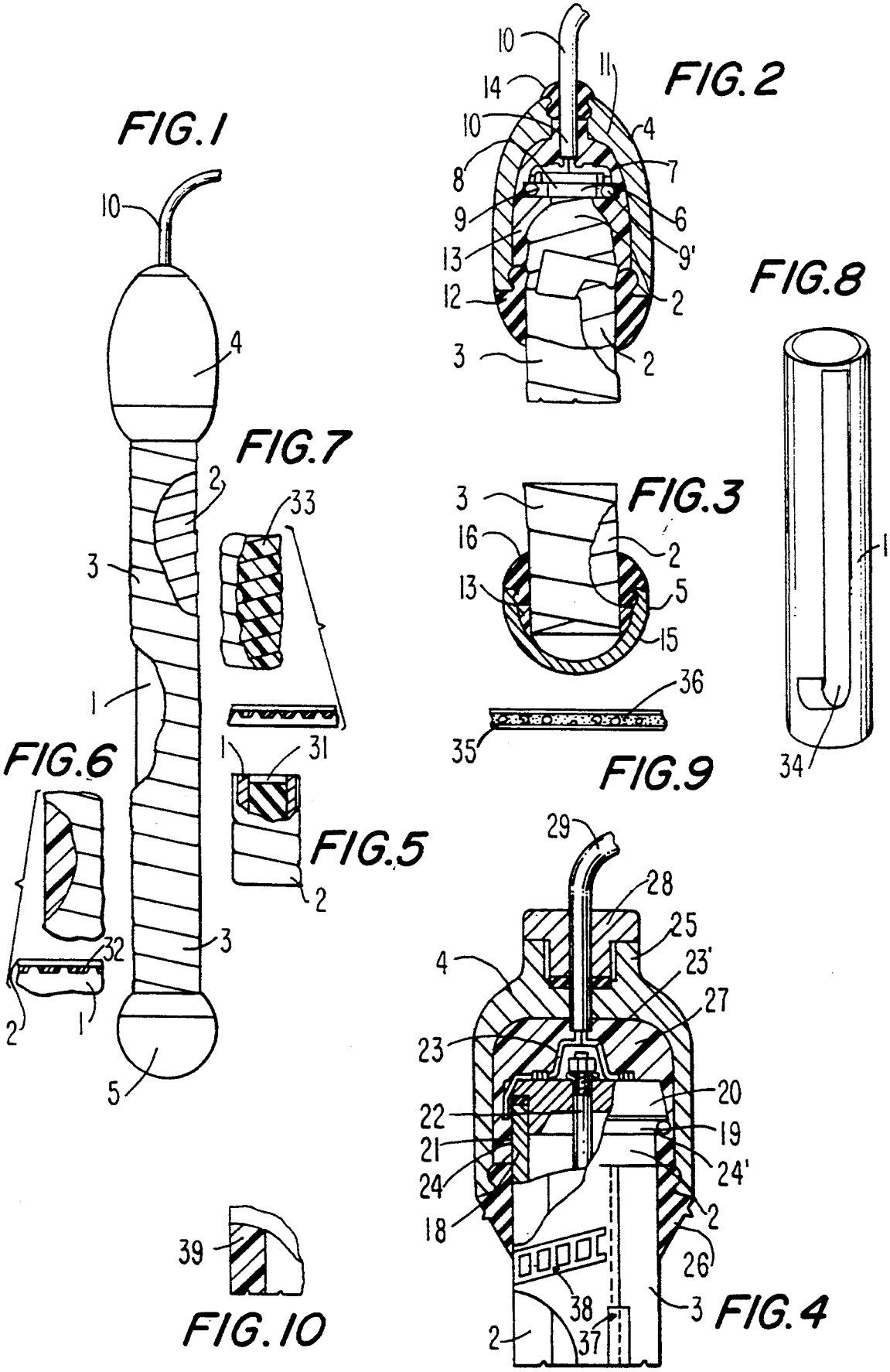
FIG. 1 is a view showing an indissoluble anode in accordance with the present invention.
FIG. 2 is a view showing an anode head on an upper end of the anode in accordance with the present invention, on an enlarged scale.
FIG. 3 is a view showing an anode head on an opposite end of the anode in accordance with the present invention, on an enlarged scale.
FIG. 4 is a view showing an anode head in accordance with another embodiment of the present invention.
FIG. 5 is a view showing still a further embodiment of the inventive indissoluble anode.
FIGS. 6–10 are views showing further modifications of the invention.

FIG. 1 shows an indissoluble anode in accordance with one embodiment of the present invention. It has a core 1 with a small diameter preferably approximately 20 millimeters and formed as a rod, or a tube or a profile of a plastic material which is resistant to compression and bending. A thin first coating 2 composed of copper and having a thickness ranging between 0.01 and 0.1 mm is applied on the core 1. A thin second coating 3 composed of titanium and having a thickness normally ranging between 0.01 and 0.1 mm is applied on the first coating 2. The external surface of the second coating is covered by a thin indissoluble, current dissipating layer. The current dissipating layer is composed of an electrically deposited noble metal, preferably platinum, or a thermally deposited metal oxide such as of titanium, iridium or ruthenium.

The coating 2 of copper is produced either by spirally wrapping a tape onto the plastic core or by enveloping the plastic core with a continuous foil. In both cases the tape or the foil may be stuck on the plastic core and an overlap of a few millimeters between spirals or borders of the tape or the foil is formed. The inert coating 3 of titanium is also produced either by spirally wrapping a tape or by enveloping a foil which may be stuck onto the copper coating 2 underneath and may have an overlap between spirals or borders preferably not less than 5 millimeters. In order to provide the above sticking, adhesives are used of mono-component or bi-component type with an elevated coefficient of adhesion and resistance to water, other electrolytes and oils in which the anode is expected to function as a ground-bed. The adhesive on the titanium coating is highly electroconductive, for example by means of metal granules dispersed within its matrix. Whenever the free surface of the copper coating gets sandblasted until 20 micron asperities are obtained throughout, the adhesive on the titanium coating need not be electroconductive.

The upper end of the anode is provided with a feeder cable 10 and the lower end of the anode is protected so as to prevent current dissipation from the copper coating 2.

The upper end of the anode is provided with an anode head 4 shown in FIG. 2. The copper coating 2 is extended up to an upper end 6 of the core 1 and terminates in a toroidal expansion 7. A copper clamp 8 is housed by the toroidal expansion and tightened on the copper coating 2. It is also connected to the twin feeder cable 10 via cable lugs 9 and 9' by tiny locking bolts or nuts. The inert titanium coating 3 finishes a few centimeters from the copper clamp 8 and remains inside the anode head 4. The head includes a shell 11 of a correspondingly shaped plastic material. A toroidal element 12 is forcibly housed in the lower end of the shell 11 and composed of elastic material to seal the lower end of the anode head. The head is filled with hardened insulating material 13 and sealed on the top by an elastic material stopper 14. The stopper has a through hole for passage of the electric feeder cable 10.

The opposite end of the anode is shown in FIG. 3. It has an anode head 5 which includes a shell 15 of a correspondingly shaped plastic material, a toroidal element 16 composed of an elastic material, and a filler of a hardened insulating material 13 similar to that of the upper anode head 4. When more anodes are needed in series, the anodes are provided also at their lower ends with the anode heads 4.

Anodes of a greater diameter are generally provided with cores formed as plastic tubes with a high resistance to radial crushing and bending. The anode head 4 for such an anode is shown in FIG. 4. It has a core formed as a tube and identified with reference numeral 18. The core is coated with two coatings 2 and 3 similar to the coatings mentioned hereinabove and using the alternative "cigarette wrap" method. The coating 3 finishes inside the anode head 4 while the copper coating 2 protrudes beyond this point and is gripped on the upper end of the tube 18 by a copper clamp 19. Both ends of the tube are closed by stoppers provided with sealing toroidal gaskets 21. The gaskets have a central through hole for passage of a small diameter rod or tube 22 with threaded ends for locking the stoppers on the tube, by means of nuts. The tube may contain an additional material to make it heavier. Two elements 23 and 23' of the feeder cable 29 are fixed on the stopper and connected to cable lugs 24 and 24' of the copper clamp 19. The anode head 4 is then completed by a shell 25 of a plastic material. Its lower part is closed by an element 26 of an elastic material which is forcibly inserted between the tube 18 and the shell 25. A hardened resin filler 27 and a stopper 28 hermetically seal the through hole which forms a passage for the feeder cable 29. The opposite end of the tube is closed by a shell similar to that of 25 of the anode head 4, but with the use of a stopper which is similar to the stopper 28 but does not have the through hole.

If the anodes are to be used in series, the lower anode heads may be totally identical to the upper anode heads. In this case the core 22 formed as a rod or a tube may have its threaded part elongated beyond the locking nut, thus serving as a stretch onto which an internally threaded tube end may be screwed and through which the feeder cable 29 passes. This tube which has to be elongated beyond the anode head to form the anode column, must be correspondingly coated with electroinsulating material.

The cores formed as a rod, a tube, a profile of the inventive anode may be composed not only of a plastic material, but also of metal or metal alloy. Whenever the surfaces of the said metal anodes or metal alloy anodes are sandblasted so that 20 micron asperities are obtained throughout, the adhesive on the titanium coating need not be electroconductive. When the metal cores are used they may be previously hot or cold coated with an electroinsulating material and subsequently treated in the same way as for the plastic cores. The glueing of the first copper coating 2 on the plastic support of the anode may be limited to two ends of the anode only. The anodes may be protected by means of a wide meshed tubular net composed of plastic. The anodes can conform to any geometrical shape and can have any feasible dimension required for their usage. The overlapping of the longitudinal border of the activated titanium foil is in any case secured either by welding or by a narrow strip of strongly adhesive plastic material. The anode support consists of a cylinder composed of polyurethane or another synthetic insulating material having a small diameter steel core along its axis.

FIGS. 6–10 show some further modifications of the invention. The core 1 shown in FIG. 5 is hollow, and an additional material 31 is contained in the core to make it heavier. The core 1 in FIG. 6 is sandblasted to create asperities 32 up to 20 microns high. The copper tape in FIG. 7 is also sandblasted and has asperities 33. FIG. 8 shows the copper layer which is formed by at least one copper strip 34 having a thickness of substantially 1 mm and a width of substantially at least 1 cm, and fixed along a longitudinal generatrix of the core 1. FIG. 9 shows an adhesive for glueing the titanium layer, which adhesive is highly electro-conductive and includes a plurality of metal granules 35 dispersed within its matrix 36. Reference numeral 37 on FIG. 4 identifies a narrow strip composed of strongly adhesive plastic material and securing the overlap zone of the titanium layer. Reference numeral 38 in FIG. 4 identifies a wide meshed tubular net which is composed of an electroinsulating material to protect the anode. FIG. 10 shows a copper foil which is sandblasted and provided with asperities 39.

It will be understood that each of the elements described above, or two or more together, may also find a useful application in other types of constructions differing from the types described above.

While the invention has been illustrated and described as embodied in an inert anode for dissipation of continuous current, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An indissoluble anode for the dissipation of continuous current for electrochemical plants and especially so for cathodic protection plants, the anode comprising a rigid core having a high resistance to radial crushing and bending; an inner electroconductive layer of copper applied on said core; an outer layer composed of titanium and applied over said inner copper layer so as to be electrically connected with the latter, said layer of titanium having a free surface; a film of an indissoluble and current-dissipating metal applied on said free surface of said titanium layer, said core being formed as an element having two ends, said copper layer extending beyond said titanium layer; a copper clamp which grips said copper layer at a location beyond said titanium layer; stoppers provided with filling gaskets and closing said ends of said element, each of said stoppers having a central through hole; and a small diameter member passing through said hole.

2. An indissoluble anode as defined in claim 1, wherein said core is hollow; and further comprising an additional material contained in said core to make it heavier.

3. An indissoluble anode as defined in claim 1, wherein said core is composed of a material selected from the group consisting of a metal and a metal alloy.

4. An indissoluble anode as defined in claim 1, wherein said core has a surface which is sandblasted to create asperities up to 20 microns high.

5. An indissoluble anode as defined in claim 4, wherein said titanium layer is forcibly pressed against said sandblasted surface of said core.

6. An indissoluble anode as defined in claims 4; and further comprising an adhesive which glues said copper layer on said core, wherein said adhesive has a thickness such that said asperities perforate said adhesive on application.

7. An indissoluble anode as defined in claim 1; and further comprising a layer of electroinsulating material covering said core.

8. An indissoluble anode as defined in claim 1, wherein said core is composed of a synthetic insulating material; and further comprising an inner element coaxial with said core and composed of a material selected from the group consisting of a metal and a metal alloy.

9. An indissoluble anode as defined in claim 1, wherein said core is composed of polyurethane.

10. An indissoluble anode as defined in claim 1, wherein each of said copper layer and titanium layer has a thickness of between 0.01 and 0.1 mm.

11. An indissoluble anode as defined in claim 1, wherein said titanium layer is a titanium tape spirally wrapped on said copper layer, with an overlap of a few millimeters between its spirals.

12. An indissoluble anode as defined in claim 11, wherein said overlap of said titanium layer is secured to form a waterproof sealing.

13. An indissoluble anode as defined in claim 12, wherein said overlap of said titanium layer is secured by welding.

14. An indissoluble anode as defined in claim 12, wherein said overlap of said titanium layer is secured by a narrow strip of strongly adhesive plastic material.

15. An indissoluble anode as defined in claim 1, wherein said titanium layer is a continuous titanium foil with an overlap of a few millimeters between its longitudinal borders.

16. An indissoluble anode as defined in claim 1, wherein said copper layer has a free surface which is sandblasted to provide asperities up to 20 microns high, said titanium layer being forcibly pressed against said sandblasted surface of said copper layer.

17. An indissoluble anode as defined in claim 16; and further comprising an adhesive which glues said titanium layer on said copper layer, said adhesive having a thickness such that said asperities perforate said adhesive on application.

18. An indissoluble anode as defined in claim 1, wherein said copper layer is a copper tape spirally wrapped on said core, with an overlap of a few millimeters between its spirals.

19. An indissoluble anode as defined in claim 1, wherein said copper layer is a continuous copper foil enveloping said core, with an overlap of a few millimeters between its longitudinal borders.

20. An indissoluble anode as defined in claim 1, wherein said copper layer is formed by at least one copper strip having a thickness of substantially 1 millimeter and a width of substantially at least 1 centimeter, said copper strip being fixed along a longitudinal generatrix of said core.

21. An indissoluble anode as defined in claim 1; and further comprising an adhesive which glues said copper layer on said core.

22. An indissoluble anode as defined in claim 21; and further comprising an adhesive which glues said titanium layer on said copper layer.

23. An indissoluble anode as defined in claim 22, wherein each of said adhesives is selected from the group consisting of a mono-component adhesive and a bi-component adhesive with an elevated adhesion coefficient and resistance to water, other electrolytes and oils in which the anode is expected to function.

24. An indissoluble anode as defined in claim 22, wherein said adhesive for glueing said titanium layer is highly electroconductive and includes a plurality of metal granules dispersed within its matrix.

25. An indissoluble anode as defined in claim 1, wherein said film is composed of a noble metal.

26. An indissoluble anode as defined in claim 1, wherein said film is composed of an oxide of a metal selected from the group consisting of ruthenium, titanium and iridium.

27. An indissoluble anode as defined in claim 1, wherein said film is an electrolytically deposited film.

28. An indissoluble anode as defined in claim 1, wherein said film is a thermally deposited film.

29. An indissoluble anode as defined in claim 1; and further comprising means for electrically isolating an upper extremity of the anode and a feeder cable for electrical current in the region of the upper extremity; and means for electrically isolating a lower extremity of the anode to avoid electrical dissipation from an end of said copper layer and said core, each of said means for electrically isolating being formed as a cap arranged over the respective extremity and formed as an anode head.

30. An indissoluble anode as defined in claim 29, wherein each of said anode heads includes a shell of a plastic material with an open end; an element forcibly housed within said open end and composed of elastic material to seal said anode head, and a hardened insulating material which fills said head.

31. An indissoluble anode as defined in claim 29, wherein said anode heads include identical upper and lower anode heads.

32. An indissoluble anode as defined in claim 1, wherein said core has an upper end with an expansion, said copper layer extending up to said upper end, and said titanium layer finishing a few centimeters before said copper clamp.

33. An indissoluble anode as defined in claim 32; and further comprising means for connecting said copper clamp to a twin feeder cable including cable lugs, locking bolts and nuts.

34. An indissoluble anode as defined in claim 1, wherein said small diameter member has ends which are threaded; and further comprising locking nuts which lock said stoppers onto said threaded ends of said small diameter member.

35. An indissoluble anode as defined in claim 1; and further comprising a wide meshed tubular net composed of an electroinsulating material to protect the anode.

36. An indissoluble anode for cathodic protection and electrochemical plants, comprising a core formed as a tube composed of plastic, electroinsulating material; a thin layer of titanium coating said core and having a free surface; a thin indissoluble film coating said free surface of said layer of titanium and composed of a material selected from the group consisting of a noble metal and an oxide of a metal; a copper clamp electrically connecting said layer of titanium with an outside supply; and means closing and sealing upper and lower ends of the anode.

37. An indissoluble anode as defined in claim 36, wherein said oxide is a thermally obtained oxide.

38. An indissoluble anode as defined in claim 36, wherein said oxide is an oxide of a metal selected from the group consisting of iridium, ruthenium and titanium.

39. An indissoluble anode as defined in claim 36, wherein said means for closing and sealing include shaped caps.

40. An indissoluble anode as defined in claim 36, wherein said means for closing and sealing include anode heads.

41. An indissoluble anode as defined in claim 36, wherein said core is formed as a tube containing an additional material to make it heavier.

42. An indissoluble anode as defined in claim 36; and further comprising at least one copper strip interposed between an external surface of said core and said layer of titanium, said strips having surfaces which are in contact with said layer of titanium and provided with electroconductive adhesive in order to keep an electronic contact with said layer of titanium.

* * * * *